US006932754B2

(12) United States Patent
Fujishiro et al.

(10) Patent No.: US 6,932,754 B2
(45) Date of Patent: Aug. 23, 2005

(54) METHOD FOR MANUFACTURING ANGULATED BOTTOM PAPER BAG WITH HANDLE IN ROTARY TYPE BAG MANUFACTURING MACHINE

(75) Inventors: Masaki Fujishiro, Tokyo (JP); Tatsuya Ijiro, Shibata (JP)

(73) Assignee: Newport Corp. (JP)

( * ) Notice: Subject to any disclaimer, the term of this patent is extended or adjusted under 35 U.S.C. 154(b) by 0 days.

(21) Appl. No.: 10/431,620

(22) Filed: May 7, 2003

(65) Prior Publication Data

US 2004/0224830 A1 Nov. 11, 2004

(51) Int. Cl.[7] ..... B31B 1/86

(52) U.S. Cl. ..... 493/226; 493/186; 493/210; 493/231; 493/235; 493/926; 493/223; 493/221

(58) Field of Search ..... 493/186, 210, 493/226, 231, 235, 291, 255, 926, 223, 221

(56) References Cited

U.S. PATENT DOCUMENTS

| | | | | | |
|---|---|---|---|---|---|
| 1,690,626 | A | * | 11/1928 | Duvall | 493/255 |
| 2,346,710 | A | * | 4/1944 | Steen | 493/226 |
| 2,469,536 | A | * | 5/1949 | Winesett | 493/221 |
| 2,985,355 | A | * | 5/1961 | Read | 493/221 |
| 3,025,768 | A | * | 3/1962 | Kessler | 493/223 |
| 3,040,633 | A | * | 6/1962 | Davis | 493/226 |
| 3,464,325 | A | * | 9/1969 | Class | 493/223 |
| 3,698,289 | A | * | 10/1972 | Kamins et al. | 493/226 |
| 3,722,377 | A | * | 3/1973 | Hayes | 493/226 |
| 3,835,756 | A | * | 9/1974 | Bosse | 493/226 |
| 3,850,724 | A | * | 11/1974 | Lehmacher | 493/226 |
| 3,853,040 | A | * | 12/1974 | Achelpohl | 493/255 |
| 5,382,215 | A | | 1/1995 | Mattiebe | |
| 5,421,805 | A | * | 6/1995 | Baxter et al. | 493/226 |

FOREIGN PATENT DOCUMENTS

| | | |
|---|---|---|
| JP | 49-63574 A | 6/1974 |
| JP | 50-122375 | 9/1975 |
| JP | 11-320716 A | 11/1999 |

* cited by examiner

*Primary Examiner*—John Sipos
*Assistant Examiner*—Michelle Lopez
(74) *Attorney, Agent, or Firm*—Akerman Senterfitt

(57) ABSTRACT

The invention concerns a rotary type bag manufacturing machine which feeds continuously material paper (R) to form angulated bottom bags (B) with handles (T) in which a top edge (S2) with the handles (T) pasted can be folded toward an inside in the manufacturing process. Material paper (R) wound in a roll is continuously fed out. After forming lateral slits (15) and Letter-J-shaped nicks (16) on the material paper (R) by an incising device (4), reinforcing papers (T1) for handles (T) formed by a handle forming device 2 are pasted. Then, a cutting device (6) cuts off the material paper (R) on a cut line aligned with the lateral slits (15) to thereby form the material paper (R) with the handles (T) which remains unfolded in a plane. A cut end portion (S2) with each handle (T) pasted is folded toward an inside to invisibly cover each reinforcing paper (T1) for the handle (T). Thereafter, angulated bottom paper bags (B) are formed through a paper tube forming process and a bottom folding process.

8 Claims, 7 Drawing Sheets

METHOD FOR MANUFACTURING ANGULATED BOTTOM PAPER BAG WITH HANDLE IN ROTARY TYPE BAG MANUFACTURING MACHINE

BACKGROUND OF THE INVENTION

The present invention relates to a method for manufacturing paper bags with angulated bottoms and handles (hereinafter called angulated bottom paper bags with handles) such as shopping bags or the like by continuously moving a material paper forward in a rotary type bag manufacturing machine.

Conventionally, two types of machines are known in the prior art for manufacturing angulated bottom paper bags with handles, such as shopping bags or the like. One is a rotary type bag manufacturing machine for fabricating angulated bottom paper bags with handles by feeding a material paper wound in a roll substantially successively. The other is a sheet-fed type bag manufacturing machine for fabricating angulated bottom paper bags with handles by feeding a material paper cut to a predetermined size.

A rotary type bag manufacturing machine is disclosed, for example, in a Japanese un-examined patent publication 50-122375. As shown in FIG. 6, after pasting handles T to a material paper R which is wound in a roll and being fed out, the material paper R is folded in two and pasted together to form a sequential paper tube P, and then the paper tube P is cut off at a portion where handles are pasted as indicated by an arrow A in FIG. 6, thus forming an individual paper tube S provided with the handle T at its top edge portion. Thereafter, each paper tube S with the handle is folded at its bottom so that an angulated paper bag with a handle is fabricated.

Such type of the conventional rotary type bag manufacturing machine has an advantage that angulated bottom paper bags with handles can be fabricated efficiently by feeding out a material paper R wound in a roll substantially successively, and thus the production costs thereof can be reduced. However, it has drawbacks that a top edge of the paper tube S with the handle T cannot be folded toward the inside thereof as the material paper R with the handle T is pasted together to take the shape of pouch and then the paper tube P is cut off at a portion where the handle T is pasted. Therefore, not only tie opening of the bag allows its cut end to remain untrimmed, but also the reinforcing paper T1 such as craft paper for attaching the handle T becomes visible directly from the opening of the bag, which impairs the attractiveness of the bag, making it difficult to fabricate angulated bottom paper bags of a high-grade impression. Besides, when putting something in the bag, it is likely to be caught in the reinforcing paper. Particularly when it is heavy, the handle is apt to come off.

In this respect, the sheet-fed type bag manufacturing machine is advantageous because, as shown in FIG. 7, after feeding a sheet-like material paper R cut one by one to a predetermined size and then pasting the handle T thereto, a top edge thereof is folded toward an inside with the handle T being passed through a slit (not shown in FIG. 7) formed on the edge portion of the material paper R, so that a material paper R unfolded in a plane is pasted together with the reinforcing paper T1 of the handle T being invisibly covered with a tuck R1, thus enabling the fabricating of the paper tube S with handle. Accordingly, it is possible to trim a top edge portion of an angulated bottom paper bag by folding its edge toward the inside, enabling the fabricating of angulated bottom paper bags with handles with excellent design, giving luxury feeling as the reinforcing paper T1 of the handle T is invisibly covered with the tuck R1.

However, the sheet-fed type bag manufacturing machine has drawbacks such as the low speed in paper bag manufacturing, inferior productivity and high production cost of angulated bottom paper bags as compared with the rotary type bag manufacturing machine which is capable of feeding a material paper R continuously to form the paper R into angulated bottom paper bags continuously.

It is an object of the present invention to bring solutions to such problems and to provide a rotary type bag manufacturing machine, which enables angulated bottom paper bags with handles to be formed with excellence in design and high resistance to load as its top edge portion with the pasted handle is folded toward an inside thereof.

It is another object of the present invention to provide a rotary type bag manufacturing machine, which can provide angulated bottom paper bags with handles into which things are easy to put.

To solve the aforementioned problems, the present invention can provide a rotary type bag manufacturing machine which moves a material paper wound in a roll forward to fold the paper after handles are pasted to the paper, forming continuously angulated bottom paper bags, wherein angulated bottom paper bags with handles are formed continuously through following processes; a cutting process for forming lateral slits and Letter-J-shaped nicks connected to the lateral slits on a fed material paper; a handle pasting process for forming handle pasting portions adjacent to said Letter-J-shaped nicks, a reinforcing paper pasting process for pasting reinforcing papers for attaching handles to the handle pasting portions, a material paper cutting process for forming cut lines connected to said lateral slits to cut off said material paper in lateral direction, a top edge folding process for pasting the cut end portion to be folded into an inside thereof, a paper tube forming process for forming a paper tube by making the material paper approximately doubled, and a bottom folding process for folding a bottom of the paper tube So that angulated bottom paper bags with handles can be continuously formed through the aforementioned processes.

According to the aforementioned construction, the material paper wound in a roll is continuously fed, while in a process prior to pasting the reinforcing papers for the handles, the lateral slits are formed at positions corresponding to strings of the handles and the letter-J-shaped nicks are formed consecutively to these lateral slits. Further, the reinforcing papers for attaching the handles are pasted to the material paper so that the strings of the handles partially overlap the lateral slits. Thus, after the reinforcing papers are pasted, in the material paper cutting process, by forming cut lines so as to connect to the lateral slits, the material paper with handles is cut off. Consequently, the material paper with handles is hereafter fed in a state where it is unfolded in a sheet-like pane. Further, the Letter-J-shaped nicks connected to the lateral slits are formed in the material paper before the reinforcing papers for the handles are pasted, while these Letter-J-shaped nicks are formed at the positions corresponding to the strings of the handles so that when an end portion cut in the material paper cutting process can be folded into an inside thereof, the strings of the handles slip through the Letter-J-shaped nicks, thus enabling to fold the cut end portion of the material paper into the inside thereof. Thus, in a state where the reinforcing papers for the handles are covered up, the angulated bottom paper bags with the handles are formed through a subsequent paper tube forming process and bottom folding process. Consequently, angulated bottom paper bags can be formed continuously where since the reinforcing papers of handles are covered with a top edge folded portions, an exterior appearance excels, resistance to load is high, and things are easy to put therein.

Figure 4:
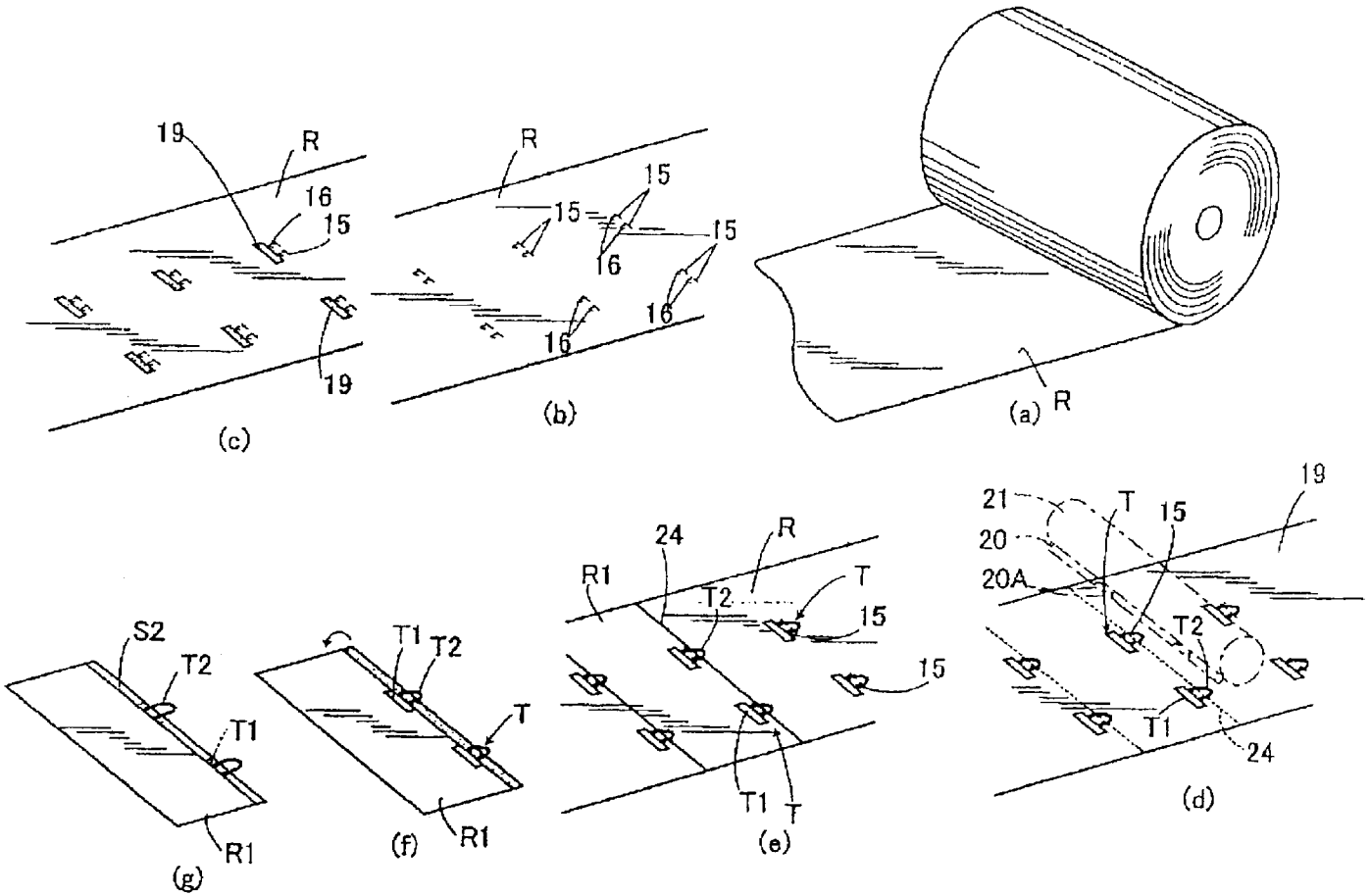

FIG. 4 is an explanatory diagram showing the process flow of the bag manufacture, in which FIG. 4(*a*) shows a material paper feeding process, FIG. 4(*b*) a cuts making process, FIG. 4(*c*) a pasting process, FIG. 4(*d*) a reinforcing paper pasting process, FIG. 4(*e*) a material paper cutting process, FIG. 4(*f*) a top edge portion pasting process, and FIG. 4(*g*) a top edge portion folding process, respectively.

Figure 5:
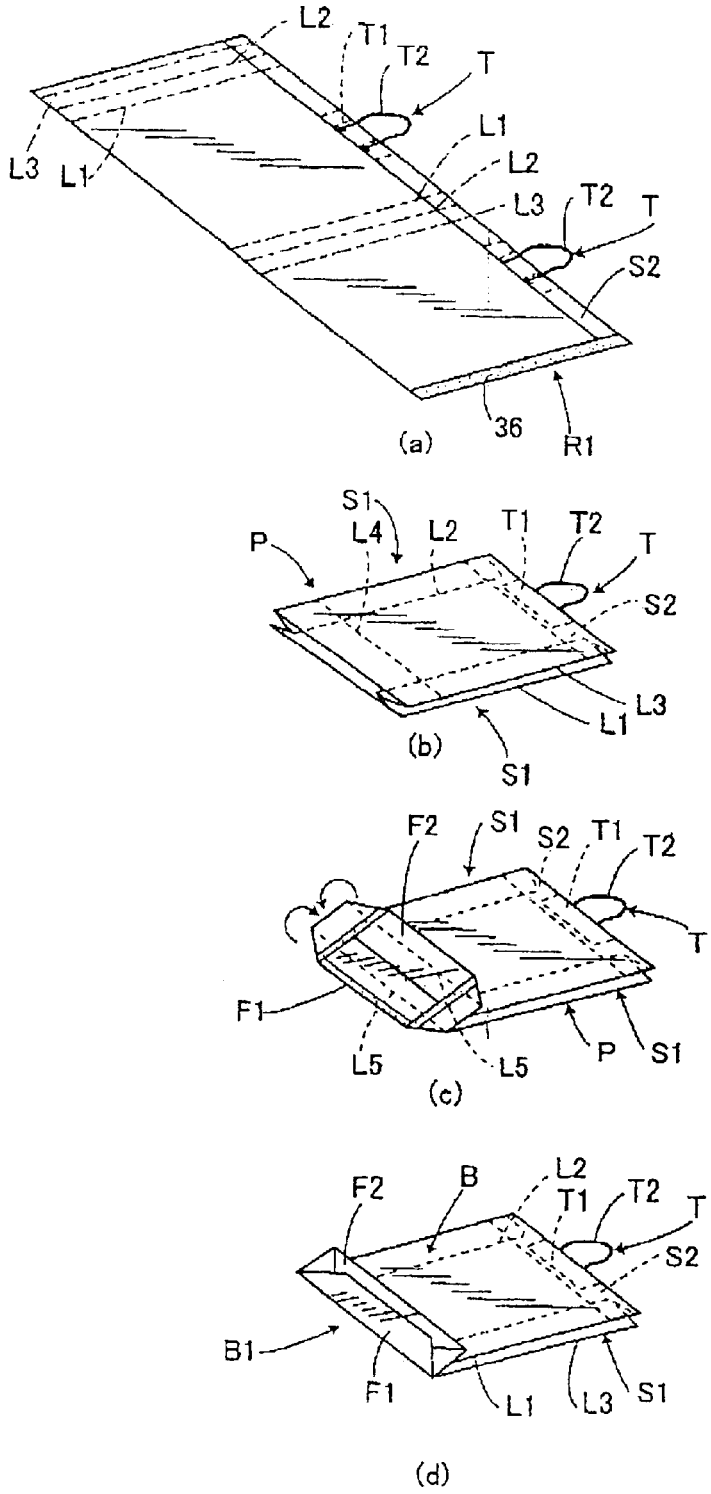

FIG. 5 is a further explanatory diagram showing the process flow of the bag manufacture, in which FIG. 5(*a*) shows a fold line Snaking process, FIG. 5(*b*) a paper tube forming process, FIG. 5(*c*) a bottom folding process, and FIG. 5(*d*) a completed angulated bottom paper bag with a handle, respectively.

Figure 6:
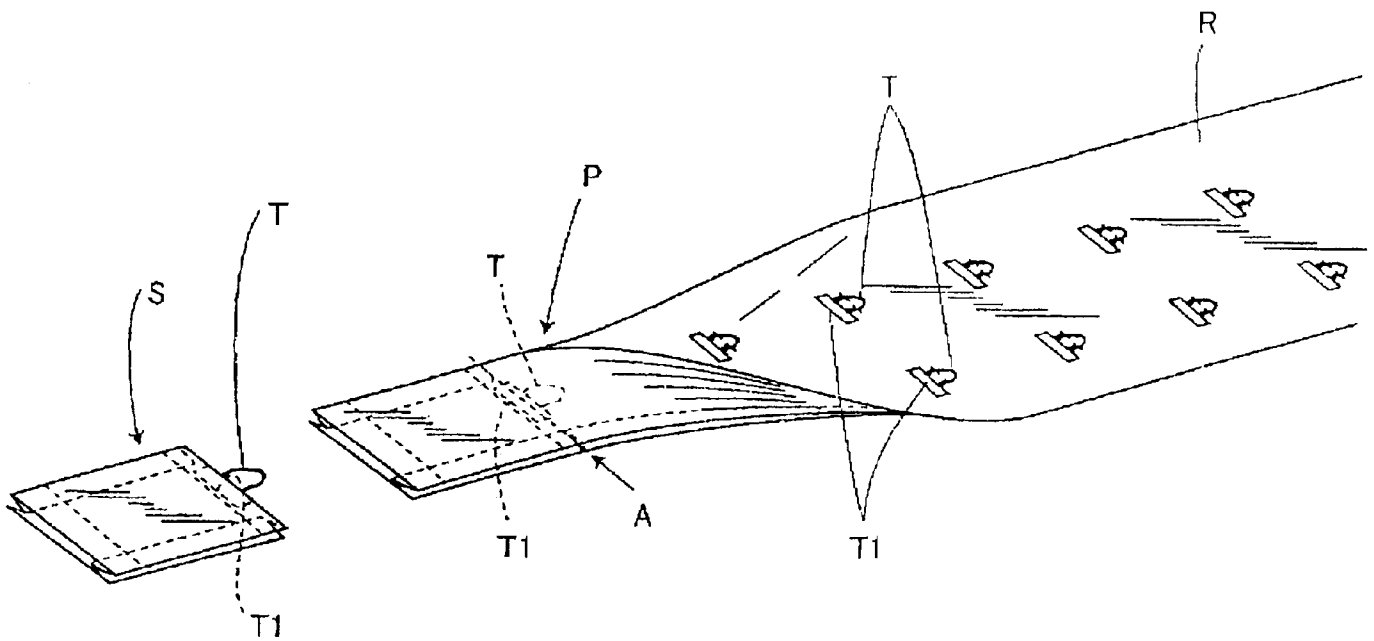

FIG. 6 is an explanatory diagram showing the process of the bag manufacture in a conventional rotary type bag manufacturing machine.

Figure 7:
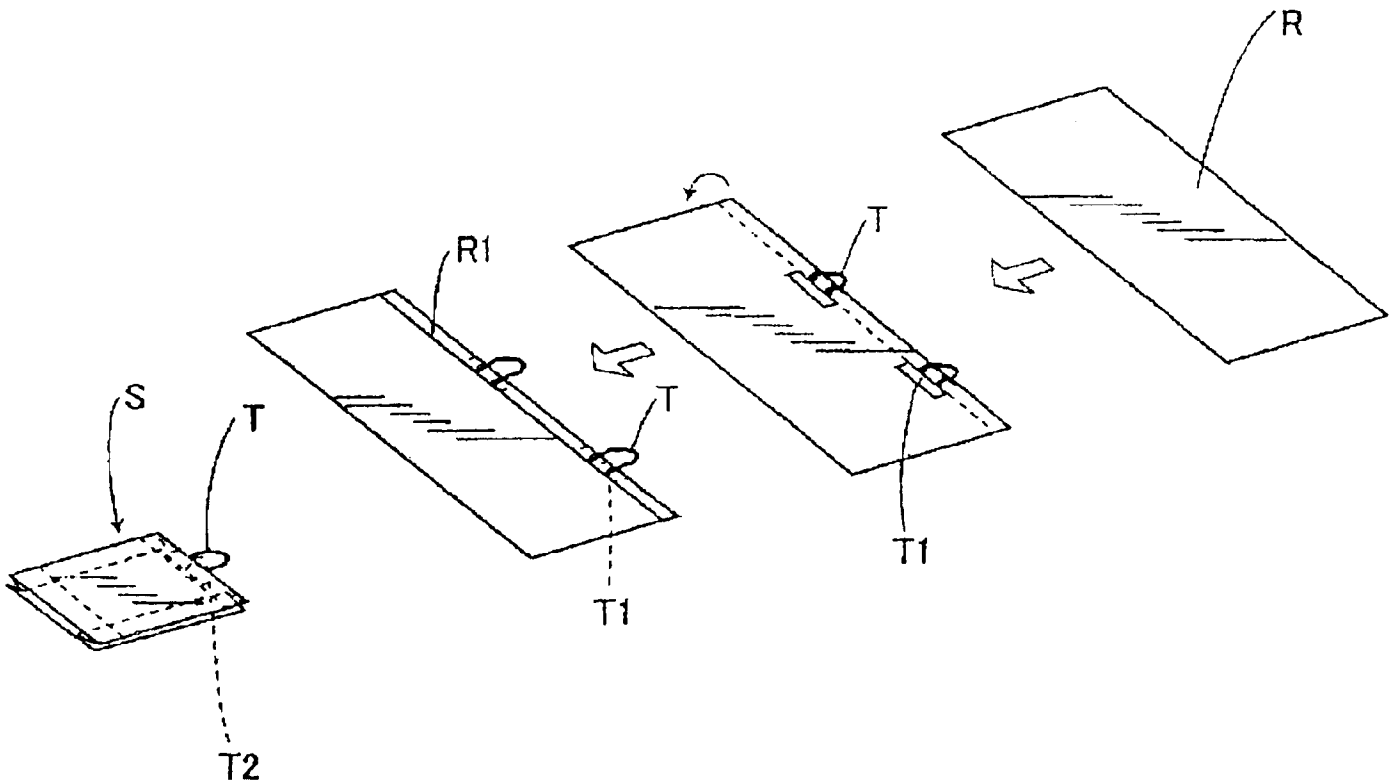

FIG. 7 is an explanatory diagram showing the process of the bag manufacture in a conventional sheet-fed type bag manufacturing machine.

Hereunder is a description of embodiments of the present invention with reference to FIG. 1 to FIG. 5. In FIG. 1 to FIG. 5, R denotes material paper; T does a handle, S a paper tube with the handle; B an angulated bottom paper bag with the handle, 1 a bag manufacturing machine, and 2 a handle forming device juxtaposed to the bag manufacturing machine 1, respectively.

The bag manufacturing machine 1 includes, a paper feeding unit 3 for feeding material paper R, an incising device 4 for forming slits in the material paper R, a handle pasting device 5, a cutting device 6 for cutting the material paper R, a top edge portion folding device 8, a body fold line making device 9, a body pasting device 10, a paper tube forming device 11 and a bottom folding device 45, and etc.

The paper feeding unit 3 continuously feeds out the material paper R wound in a roll to supply the material paper to the incising device 4 first. The incising device 4 includes a rotary roller 12 having a cutter blade (not shown in the drawings) and a pinch roller 13 to feed the material paper R between the rollers 12 and 13, forming lateral slits 15 respectively at certain positions on the paper R, corresponding to tapes T2 of the handles T as well as inverted letter-J-shaped nicks 16 extending perpendicularly from the centers of the respective slits 15. The material paper R formed thus way with the lateral slits 15 and the Letter-J-shaped nicks 16 is conveyed to a handle pasting device 19 provided with a pasting roller 18 to form pasting portions 19 at positions adjacent to the Letter-J-shaped nicks 16, using the pasting roller 18.

Figure 1:
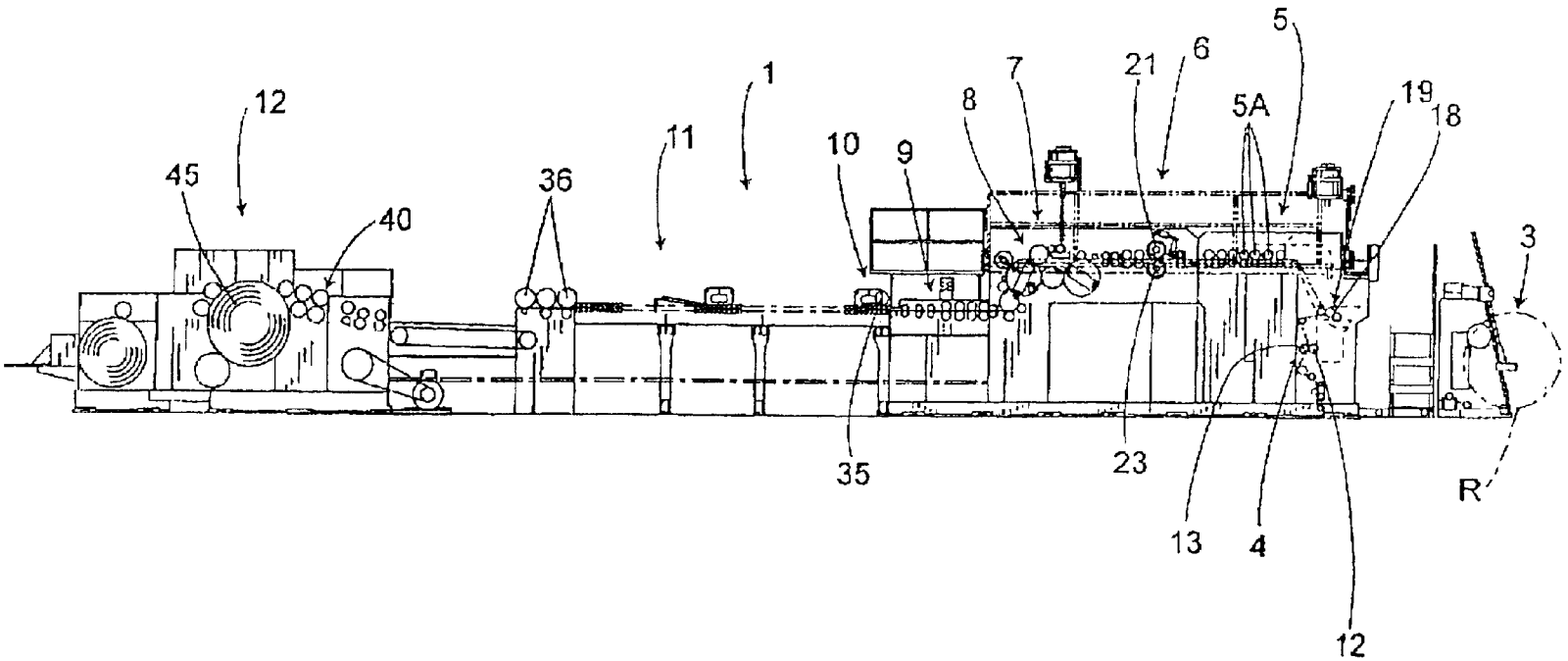
FIG. 1 is a front view showing a bag manufacturing machine according to an embodiment of the present invention.
Figure 2:
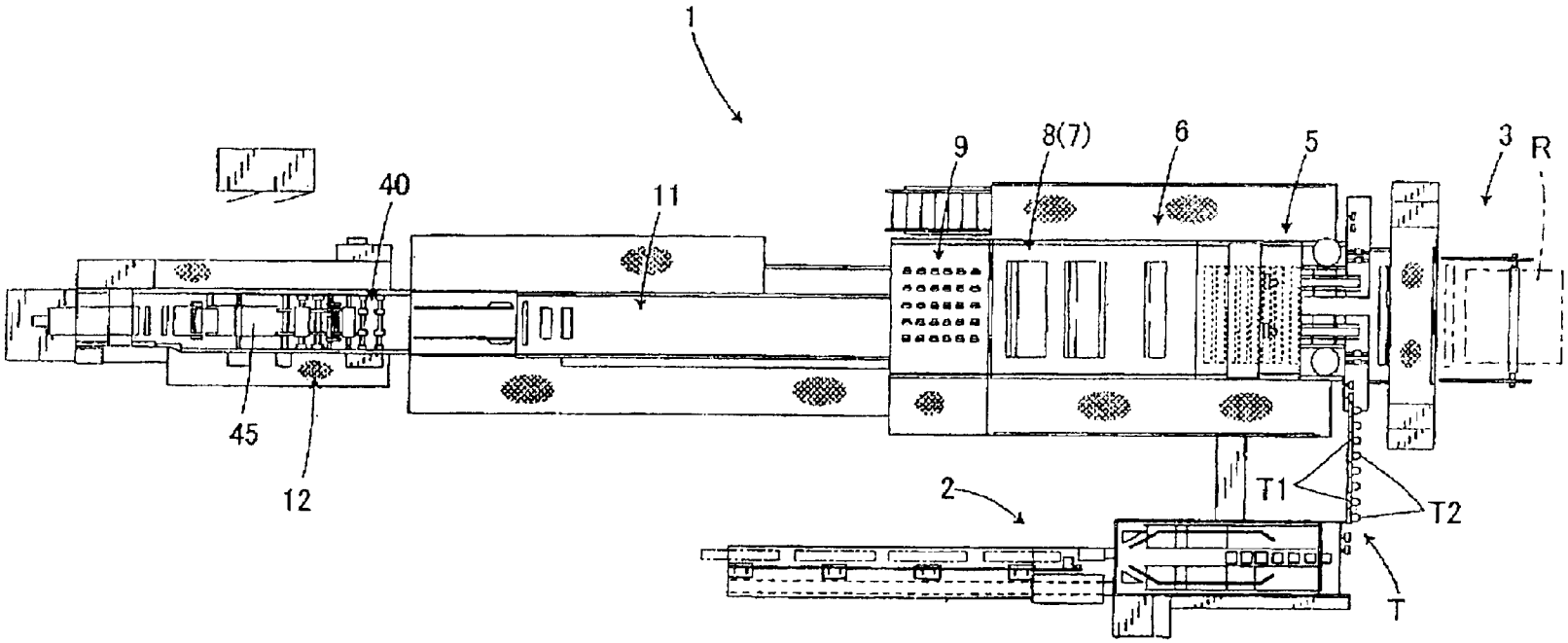
FIG. 2 is a plan view of the bag manufacturing machine of FIG. 1
Figure 3:
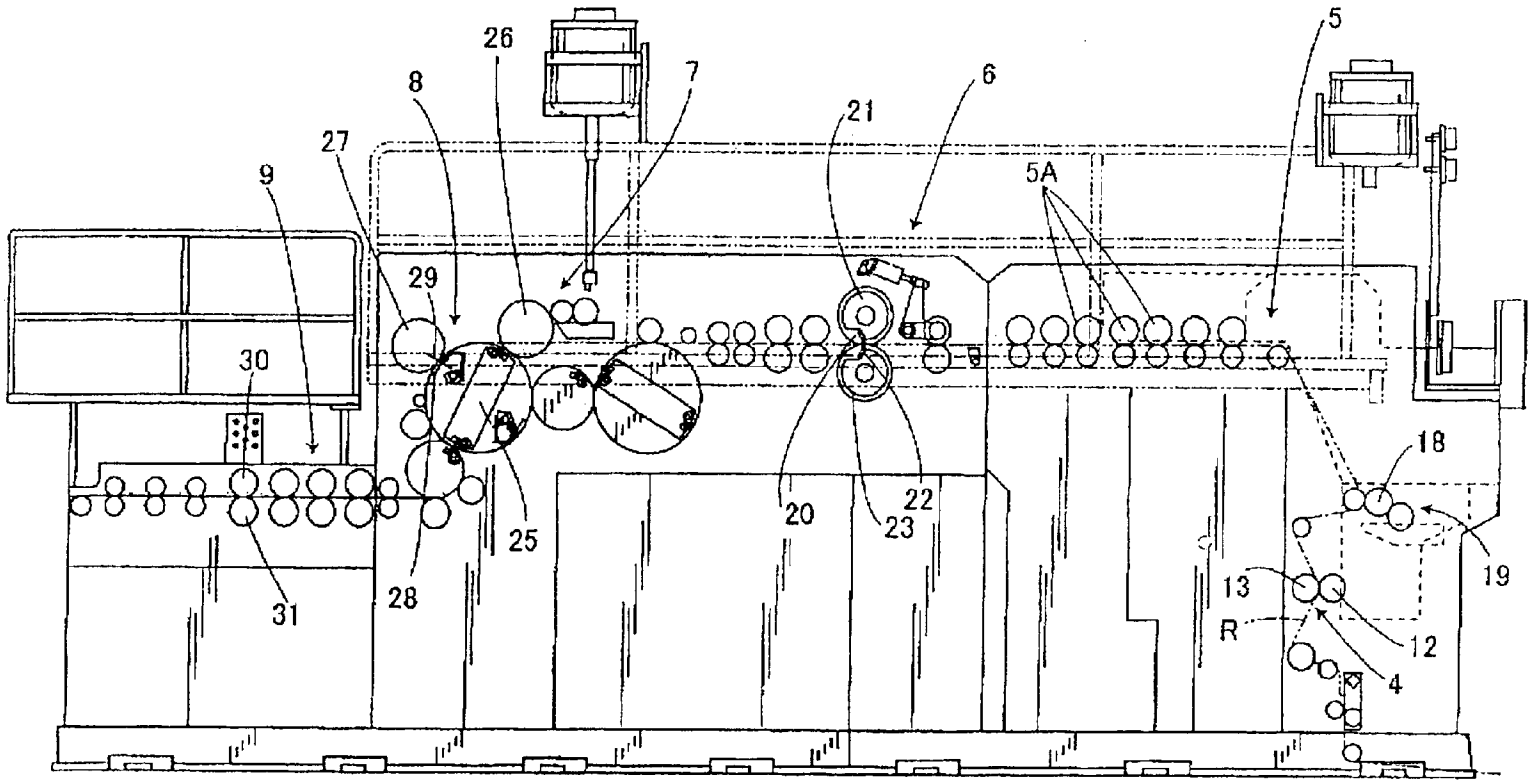
FIG. 3 is a front view of the bag manufacturing machine of FIG. 1, particularly illustrating the enlarged neighborhood of a handle pasting mechanism thereof.

The handle forming device 2, as shown in FIG. 2, is to integrate the reinforcing paper T1 made of craft paper or the like with the tapes T2 to form the handles T, and then to feed the thus reinforced handles T (hereafter simply referred to as handles) onto the aforementioned pasting portion 19, The handle pasting device 5 comprises vertically paired rollers 5A, to paste the handles T to the material paper R by feeding the paper R with the handles T to between the upper and lower rollers 5A.

The cutting device 6 comprises an upper rotating shaft 21 with a cutting blade 20 and a lower rotating shaft 23 wit a receiving portion 22 for the cutting blade 20. The aforementioned cutting blade 20, as shown in FIG. 4(*d*), is formed with cutouts 20A, corresponding to the tapes 12 of the handles T, i.e., corresponding to the lateral slits 15.

The top edge portion folding device 8 comprises, a top edge portion pasting device 7 for pasting the top edge portion of the material paper R, a rotary drum 25, and a top edge portion folding drum 27 with a top edge folding blade 29 for pushing the top edge portion of the material paper R into an opening groove 28 formed on a peripheral surface in an axial direction of the aforementioned rotary drum 25. The top edge portion pasting device 7 is provided with a pasting roller 26, while the pasting roller 26 and the top edge folding drum 27 rotate in contact with the rotary drum 25.

The body fold line making device 9 is provided with a plurality of rotary rollers 30 having a fold line making blade (not shown in the drawings) and pinch rollers 31, said fold line making blade serving to form fold lines L1, fold back lines L2 and fold lines L3 approximately in parallel with one another so that folded portions S1 of letter-M-profile can be formed on both sides of a paper bag.

The body portion pasting device 10 is, like the aforementioned top edge portion pasting device 7, provided with a pasting roller 35 to form a pasting portion 36 on an outer periphery of the material paper R1 with the handles.

The paper tube forming device 11 double-folds the material paper R1 with the handles along each of the aforesaid fold lines L1, L2 and L3 that have been already formed by the body fold line making device 9, and then pastes the pasting portions 36 together to which paste has been already applied by the body pasting device 10. Thereafter, the paper tube is pressed by press rollers 36 installed at a terminal side of the paper tube forming device 11.

For the bottom folding device 45 may be used a well-known machine in this type of bag manufacturing machines, such as a bottom folding device disclosed in Japanese Un-Examined patent publication 5-345374. That is, the device comprises, a bottom fold line making device 40 for making bottom fold back lines L4 and fold lines L5 in the vicinity of a bag bottom that will eventually become an angulated bottom of an angulated bottom paper bag B; a bottom folding drum 41 for conveying the aforementioned paper tube T through its rotation; a bottom opening device for opening a bag bottom of the paper tube T; a flap folding device for folding back folding flaps F1 and F2 along the bottom fold back lines L4 to develop the flaps F1 and F2 in a plane along the bottom folding drum 41; a pasting device for pasting aforementioned folding flaps F1 and F2; a flap erecting device for erecting the aforementioned folding flaps F1 and F2, and a bag bottom folding device for folding the folding flaps F1 and F2 toward the inside and pasting them together.

Hereunder is a description of a paper bag manufacturing method in the bag manufacturing machine constituted as above.

In the first place, as shown in FIG. 4(*a*), material paper R wound in a roll is continuously fed by the paper feeding unit 3 to the incising device 4, where the rotary roller 12 and the pinch roller 13 are rotated in the mutually reverse directions to thereby abut the cutting blade against the blade receiving portion in a posterior side of the conveying direction of the material paper R so that the lateral slits 15 and Letter-J-shaped nicks 16 are formed, as shown in FIG. 4(*b*). At this moment, the lateral slits 15 are formed in positions corresponding to the tapes T2 of the handles T. Thus, the material paper R formed with the lateral slits 15 and the Letter-J-shaped nicks 16 is conveyed to the handle pasting device 19 by the paper feeding unit 3. Here, the pasting portions 19 for the handles T are formed adjacent to the Letter-J-shaped nicks 16 by rotating the posting roller 18 along the material paper R. Then, the handles T formed by the handle forming device 2 are fed to the material paper R so that, as shown in FIG. 4(*d*), the reinforcing papers T1 of the handles T are pasted to the pasting portions 19. Thus way, the handles T are successively pasted onto the material paper R at predetermined intervals. Thereafter, the material paper R with the pasted handles T is fed to the cutting device 6, while the upper rotating shaft 21 and the lower rotating shaft 23 are rotated mutually reversely to thereby abut the cutting blade 20 against the blade receiving portion 22. At this moment, as shown in FIG. 4(*d*), the upper rotating shaft 21 is controlled so that the rotation of the upper and lower rotating shafts 21 and 23 may be synchronized with the feeding conveyance of the material paper R to thereby allow the cutting blade 20 to timely align with the lateral slits 15 of the paper R. Also, the tapes T2 of the handles T pasted to the paper R correspond to the cutouts 20A of the cutting blade 20 at that moment, while the lateral slits 15 formed in advance by the incising device 4 are timely aligned with cut lines 24 formed by the cutting blade 20. Consequently, the material paper R is cut off in the lateral direction without cutting the tapes T2 by the cutting blade 20, thereby obtaining the material paper R1 with the handles cut to a predetermined size, as shown in FIG. 4(*e*).

This material paper R1 with the handles is then conveyed to the top edge portion folding device 8, to be folded in its top edge potion by the top edge folding drum 27 having the top edge folding blade 29, nearly at the same time that the material paper R1 is pasted by the pasting roller 26 of the top edge portion pasting device 7. At this moment, the tapes T2 of the handles T are allowed to pass through the Letter-J-shaped nicks so that the top edge portion of the material paper R1 can be folded toward the inside thereof without being hindered by the tapes T2. That is, the reinforcing papers T1 of the handles T are covered with the top edge folding portions S2.

The material paper R1 with the handles, having its top edge portion for attaching the handles T folded toward the inside thus wavy is conveyed to the body fold line making device 9, so that fold lines, which will eventually become the aforesaid fold lines L1, fold back lines L2 and fold lines L3, are formed approximately in parallel along the conveying direction of the material paper R1 by rotating the roller 30 and the pinch roller 31 in the mutually reverse direction in the body fold line making device 9. Thereafter, body pasting portions 36 are formed on an outer edge of the material paper R1 with handles, using the pasting roller 35 of the body pasting device 10. Thus, the pasted material paper R1 with handles is doubled over along the fold lines L1, the fold back lines L2 and fold lines L3, using the paper tube forming device 11 so as to be pasted together by the press rollers 36 installed on the posterior side of the paper tube forming device 11. Consequently, a paper tube P with handles having letter-M-shaped folded portion S1 on both sides is formed.

This paper tube P with the handles is then conveyed to the bottom folding device 45, where the bottom fold back lines L4 and bottom fold lines L5 are, as shown in FIG. 5(*a*), formed near the bottom end of the material paper R1 with the handles, by means of the bottom fold line making device 40, so that a portion of the bottom ranging from the bottom fold lines L4 to the bottom edge is opened by the bottom folding drum 41 and the flap folding-back device attached to the drum 41, and then paste is applied to each of the folding flaps F1 and F2 by the pasting device. Thereafter, the front and back flaps F1, F2 are each folded toward the inside from the bottom fold lines L5 to be pasted together. Finally, during the conveyance by the bottom folding drum 41, the folding flaps F1 and F2 folded by the press rollers are pressed to form an angulated bottom portion B1 of the paper tube P with the handles, so that an angulated bottom paper bag B with handles is completed.

As described above, in the present embodiment, the material paper R wound in a roll is continuously fed, while in a process prior to pasting handles T, the lateral slits 15 corresponding to the tapes T2 of the handles T and the Letter-J-shaped nicks 16 connected to the lateral slits 15 are formed. After the reinforcing papers T1 of the handles T are pasted to the material paper R in a manner that the tapes T2 of the handles T span the lateral slits 15, the cut lines 24 are formed by the cutting blade 20 of the cutting device 6 so as to connect to the lateral slits 15, whereby the material paper R with the handles T is cut off, Namely, as the cutouts of the cutting part 20A in the cutting blade of the cutting device 6 are formed at the positions corresponding to the lateral slits 15, that is, to the tapes T2 of the handles T, the cutting blade 20 can cut off the material papers R in a lateral direction without cutting the tapes T2.

Consequently, in the material paper R1 unfolded in a sheet-like plane, the cut end portion on the handle-attaching side can be folded toward the inside. Further, with the reinforcing papers T1 being invisibly covered with the top edge folding portion S2 folded toward the inside, an angulated bottom paper bag B can be fabricated through the subsequent processes for forming the paper tube and then folding the bottom. Thus, there can be provided a rotary type bag manufacturing machine for manufacturing angulated bottom paper bags with handles by feeding continuously material paper R wound in a roll, wherein a completed angulated bottom paper bag B can be trimmed due to the top edge folding portion folded toward the inside and can display excellent appearance and luxury feeling due to the reinforcing papers T1 of the handles T invisibly covered with the top edge folding portion S2. Besides, as such machine is a rotary type which is able to continuously feed the material paper R wound in a roll, it has excellent productivity and can reduce production costs in the manufacture of angulated bottom paper bags B with handles.

The present invention should not be limited to the aforementioned embodiment but a variety of modifications are possible within the gist of the invention. For example, although the reinforcing papers T1 with the handles are pasted to the material paper R in the aforementioned embodiment, the respective pieces of paperboards serving as the reinforcing papers T1 may be pasted to the material paper R, and after boring the paperboards, strings may be laced through the bores to be tied to the paperboards. Further, the basic construction of the bag manufacturing machine 1 should not be limited to the aforementioned embodiment but may be suitably selected.

What is claimed is:

1. A method for manufacturing an angulated bottom paper bag using a rotary type bag manufacturing machine, which feeds out material paper wound in a roll to fold the material paper, after handles are pasted to the material paper to form angulated bottom paper bags with handles, said method comprising:

an incising process for forming lateral slits and letter-J-shaped nicks connected to the lateral slits on the fed material paper;

a handle pasting process for forming handle pasting portions adjacent to the letter-J-shaped nicks;

a reinforcing paper pasting process for pasting reinforcing papers for attaching the handles to the handle pasting portions;

a material paper cut-off process for forming cut lines connected to the lateral slits to cut off the material paper in a lateral direction;

a top edge folding process for pasting a top edge of the material paper thus cut off and then folding the same toward an inside thereof;

a paper tube forming process after the top edge folding process, said paper tube forming process forming a paper tube by substantially double-folding the material paper with the reinforcing papers thus pasted; and a bottom folding process for folding a bottom of the paper tube;

wherein said paper tube forming process is carried out after said top edge folding process, said top edge folding process being preceded by said material paper cut-off process;

wherein said lateral slits are provided at four positions located in a straight line extending in a direction perpendicular to said feed direction of the material paper, while said letter-J-shaped nicks extend from a center of each lateral slit toward a direction orthogonal to each lateral slit;

wherein said reinforcing paper is pasted adjacent to each of said letter-J-shaped nicks;

wherein said cut lines are formed so as to be aligned with said lateral slits, extending perpendicularly to said feed direction so that the material paper wound in a roll is cut off therealong to thereby obtain separated material paper sheets, each of the separated material paper sheets having a predetermined length, provided with said handle.

2. The method for manufacturing an angulated bottom paper bag using a rotary type bag manufacturing machine according to claim 1, wherein said material paper is processed with the same being unfolded in a sheet-like plane until the top edge folding process in said manufacturing process.

3. The method for manufacturing an angulated bottom paper bag using a rotary type bag manufacturing machine according to claim 1, wherein said reinforcing papers are each integrated with the handles preceding said reinforcing paper pasting process and then the handles thus reinforced are each pasted to said material paper.

4. The method for manufacturing an angulated bottom paper bag using a rotary type bag manufacturing machine according to claim 1, wherein said material paper cutting process is performed by means of a cutting blade which includes a discontinuous blade with cutouts.

5. The method for manufacturing an angulated bottom paper bag using a rotary type bag manufacturing machine according to claim 1, wherein a feeding speed of said material paper and a rotating speed of said cutting blade are so controlled that they may be synchronized with each other so as to allow the cutting blade to cut on said cut lines which align with said lateral slits.

6. The method for manufacturing an angulated bottom paper bug using a rotary type bag manufacturing machine according to claim 1, wherein:

said top edge folding process includes a step of:

passing said separated material paper sheets through an inside of a top edge portion folding device, said top edge portion folding device comprising: a top edge portion pasting device including a pasting roller for applying paste to a cut edge portion of each separated material paper sheet; a rotary drum in contact with the pasting roller, said rotary drum being formed with an opening groove on a peripheral surface thereof in an axial direction: and a top edge portion folding drum rotating in contact with the rotary drum, said top edge portion folding drum being provided with a top edge folding blade for pushing the top edge portion of the material paper sheet into the opening groove of said rotary drum, such that paste is applied to the top edge portion of the material paper sheet by the pasting roller at the same time that the tape edge portion is folded into the opening groove by the top edge folding blade to thereby fold the top edge portion.

7. A method for manufacturing an angulated bottom paper bag with a folded top edge and a handle successively through a series of steps, said method comprising the steps of:

feeding out a material paper would in a roll successively;

forming lateral slits and letter-J-shaped nicks connected to the lateral slits on the fed material paper;

pasting a reinforcing paper to adjacent to the letter-J-shaped nick;

forming cut lines connected to the lateral slits and cutting off the material paper wound in a roll into separate material paper sheets with handles, each material paper sheet having a predetermined length;

folding one top edge of each material paper sheet with the handle thus cut off toward an inside thereof with the material paper sheet being in a planar unfolded condition;

forming each material paper sheet in such planar unfolded condition into a paper tube; and forming a bottom by folding an other top edge of the material paper sheet opposite to said one top edge thereof;

wherein said lateral slits are provided at four positions located in a straight line extending in a direction perpendicular to a feed direction of the material paper, while said letter-J-shaped nicks extend from a center of each lateral slit toward a direction orthogonal to each lateral slit;

wherein said reinforcing paper is pasted adjacent to each of said letter-J-shaped nicks; and wherein said cut lines are formed so as to be aligned with said lateral slits, extending perpendicularly to said feed direction so that the material paper wound in a roll is cut off therealong to thereby obtain separated material paper sheets, each of the separated material paper sheets having a predetermined length, provided with said handle.

8. The method for manufacturing an angulated bottom paper bag with a folded top edge and a handle according to claim 7, wherein:

said folding of one lop edge is carried out inside a top edge portion folding device, said top edge portion folding device comprising: a top edge portion pasting device including a pasting roller for applying paste to a cut edge portion of each separated material paper sheet; a rotary drum in contact with the pasting roller, said rotary drum being formed with an opening groove on a peripheral surface thereof in an axial direction; and a top edge portion folding drum rotating in contact with the rotary drum, said top edge portion folding drum being provided with a top edge folding blade for pushing the top edge portion of the material paper sheet that remains in a planar unfolded condition into the opening groove of said rotary drum, such that paste is successively applied to the top edge portion of each separated material paper sheet by the pasting roller at the same time that the rope edge portion thereof is folded into the opening groove by the top edge folding blade to thereby fold the top edge portion.

* * * * *